United States Patent [19]

Haggard et al.

[11] Patent Number: 4,759,284

[45] Date of Patent: Jul. 26, 1988

[54] DAMPENER ROLLER APPARATUS

[75] Inventors: Clifford D. Haggard, Tulsa; Ralph D. Terhune, Broken Arrow; Garfield A. Wood, III, Tulsa, all of Okla.

[73] Assignee: Facet Enterprises, Inc., Tulsa, Okla.

[21] Appl. No.: 831,004

[22] Filed: Feb. 19, 1986

[51] Int. Cl.[4] ..... B41L 23/18; B41F 7/26

[52] U.S. Cl. ..... 101/148

[58] Field of Search ..... 101/148, 147, 348, 216, 101/349, 415.1; 29/120, 123, 130, 131

[56] References Cited

U.S. PATENT DOCUMENTS

| | | | |
|---|---|---|---|
| 2,543,507 | 2/1951 | Rancourt | 29/123 |
| 2,966,723 | 1/1961 | Swope | 101/148 |
| 2,966,724 | 1/1961 | Swope | 101/348 |
| 3,919,754 | 11/1975 | Sorresso | 29/120 |
| 3,926,701 | 12/1975 | Nishiwaki | 29/120 X |
| 4,589,338 | 5/1986 | Collins et al. | 101/415.1 |

FOREIGN PATENT DOCUMENTS

| | | | |
|---|---|---|---|
| 1062278 | 4/1954 | France | 101/148 |

*Primary Examiner*—J. Reed Fisher

[57] ABSTRACT

A dampener roller cartridge for mounting on a cylindrical support comprising a core tube having a central bore to receive the cylindrical support, the core tube being characterized by having an annular wall thickness of at least one-third the radius of the tube, and a coherent network structure providing a density of less than 0.5, the plastic substance and the network structure providing the tube with sufficient resilience to be resiliently deformed by a radially applied force by a mating roller and to recover its original shape after the cessation of the radially applied force, and further providing the core tube with sufficient rigidity to permit tight slidable mounting of the core tube on the cylindrical support, and a moisture-absorbent, outer sleeve secured about the circumference of the core tube. Also disclosed are securing a fabric sleeve to a core tube by heat-shrinking and double-sided adhesive tape near the ends of the core tube to prevent axial and circumferential slippage of the sleeve; and an assembly for supporting a dampener roller cartridge on a support cylinder between two end caps, one of which is held against the support cylinder via threaded axial connectors.

18 Claims, 2 Drawing Sheets

DAMPENER ROLLER APPARATUS

BACKGROUND OF THE INVENTION

The invention relates to detachable dampener rollers for printing presses.

Cylindrical, moisture-absorbent dampener rollers are used in printing presses, often in conjunction with other rollers, to apply a thin film of water, or of a water and alcohol solution, to printing plates to help prevent ink smearing. Generally, such dampener rollers are mounted on an oscillating arm that moves the roller back and forth from the water supply to the printing plate. When printing presses are stopped for any reason, the dampener roller often is pressed against the printing plate with substantial radially applied force, sometimes for a long period of time.

In many dampener roller applications, disposable moisture absorbent covers are used on reusable heavy, substantially solid, hard rubber cylinders. The cover can be a spirally wound layer of fabric (adhered by two-sided, spirally wound adhesive tape) or a water-shrinkable sleeve of paper (available from 3M) or of seamless knitted fabric (available from Jomac, Warrington, Pa.). When a cover wears out, the worn cover must be razored off carefully, to avoid damage to the roller, and a new one secured to the cylinder by winding or shrink-fitting.

Sorresso U.S. Pat. No. 3,919,754 and Swope U.S. Pat. No. 2,966,724 disclose speeding up the cover replacement process by adhering moisture absorbent covers to disposable cardboard or plastic core tubes which are slid onto and off of permanent mandrels of the printing press. Sorresso discloses a seamless cover glued to a thin core tube that is detachably mounted on a hollow metal support tube between end caps having bearings mounted on a shaft of the printing press. Swope discloses spirally-wound covers glued to thicker core tubes that are detachably mounted on disposable end cap inserts or on a printing press shaft between end caps secured (one by a radial set screw) to the shaft or on a hollow support tube between end caps (one of which is secured to the support tube by axial screws) that are mounted on the printing press shaft.

SUMMARY OF THE INVENTION

In general, in one aspect, the invention features a dampener roller cartridge for mounting on a cylindrical support comprising a core tube of plastic substance having a central bore to receive the cylindrical support, the core tube being characterized by having an annular wall thickness of at least one third the radius of the tube, and a coherent network structure providing a density of less than 0.5 gram/cc, the plastic substance and the network structure providing the tube with sufficient resilience to be resiliently deformed by a radially applied force by a mating roller and to recover its original shape after the cessation of the radially applied force, and further providing the core tube with sufficient rigidity to permit tight, slidable mounting of the core tube on the cylindrical support, and a moisture-absorbent, outer sleeve secured about the circumference of the core tube.

In preferred embodiments, the moisture-absorbent, outer sleeve is made of a seamless fabric; the fabric is a looped pile of polyvinyl alcohol yarn and rayon yarn; and the plastic material of the core tube has a density between 0.15 and 0.25 gram/cc (preferably about 0.20 gram/cc) and a durometer between 40 and 50 (preferably about 45). In some preferred embodiments, the plastic substance of the core tube includes melt-blown plastic (preferably polypropylene) fibers; in some other preferred embodiments the plastic substance includes foamed plastic (preferably polyurethane or polyethylene), plastic (preferably polyester, polypropylene or rayon) fibers bonded with phenolic resin, or string wound plastic (preferably polyester, polypropylene or rayon) fibers.

In another aspect, the invention features a dampener roller cartridge for mounting on a cylindrical support including a core tube having a central bore to receive the cylindrical support and a moisture-absorbent, heat-shrunk fabric outer sleeve that fits tightly about the circumference of the core tube.

In preferred embodiments, adhesive tape is circumferentially disposed about the core tube intermediate the core tube and the outer sleeve in order to prevent axial and circumferential movement of the sleeve on the core tube; the adhesive tape is a thin plastic film having adhesive on each side, the adhesive on the side of the tape adjacent to the core tube is pressure-activated, and the adhesive on the side of the tape adjacent to the outer sleeve cover is heat-activated; and two pieces of adhesive tape are located near the ends of the core tube.

In another aspect the invention features a dampener roller assembly including a detachable dampener roller cartridge of a hollow core tube and a moisture absorbent sleeve adhered thereto, a solid support cylinder having an outer cylindrical surface for supporting the core tube and a first threaded connector along the longitudinal axis of the support cylinder at an end of the support cylinder, a pair of end caps on both ends of the support cylinder having portions extending radially beyond the outer cylindrical surface so as to engage the ends of the core tube, and a second threaded connector mating with the first threaded connector and holding an end cap at one end. If a core tube is slightly longer than the support cylinder, it can be easily compressed using the threaded connectors.

In preferred embodiments, the end cap has a first hole through it, and the second threaded connector passes through the hole; the first threaded connector is a threaded recess in the support cylinder, and the second threaded connector is a threaded shaft mating with the threaded recess; the threaded shaft has an extension that extends axially beyond the end cap and is shaped to fit within a roller bearing; and each end cap has projections extending toward the opposite end cap at a position radially outward of the outer cylindrical surface. In some preferred embodiments, the threaded shaft has a flanged portion outward of the end cap that is larger than the hole in the end cap; and there is a roller bearing press-fitted on the extension. In some other preferred embodiments, the second threaded connector includes a nut that is on the threaded shaft outward of the end cap and is larger than the hole; and the threaded shaft has an extension at its end shaped to detachably fit within a roller bearing carried by the printing press.

Other advantages and features of the invention will be apparent from the following description of the preferred embodiments thereof and from the claims.

DESCRIPTION OF THE PREFERRED EMBODIMENTS

We first briefly describe the drawings.

Drawings

Structure

Figure 1:
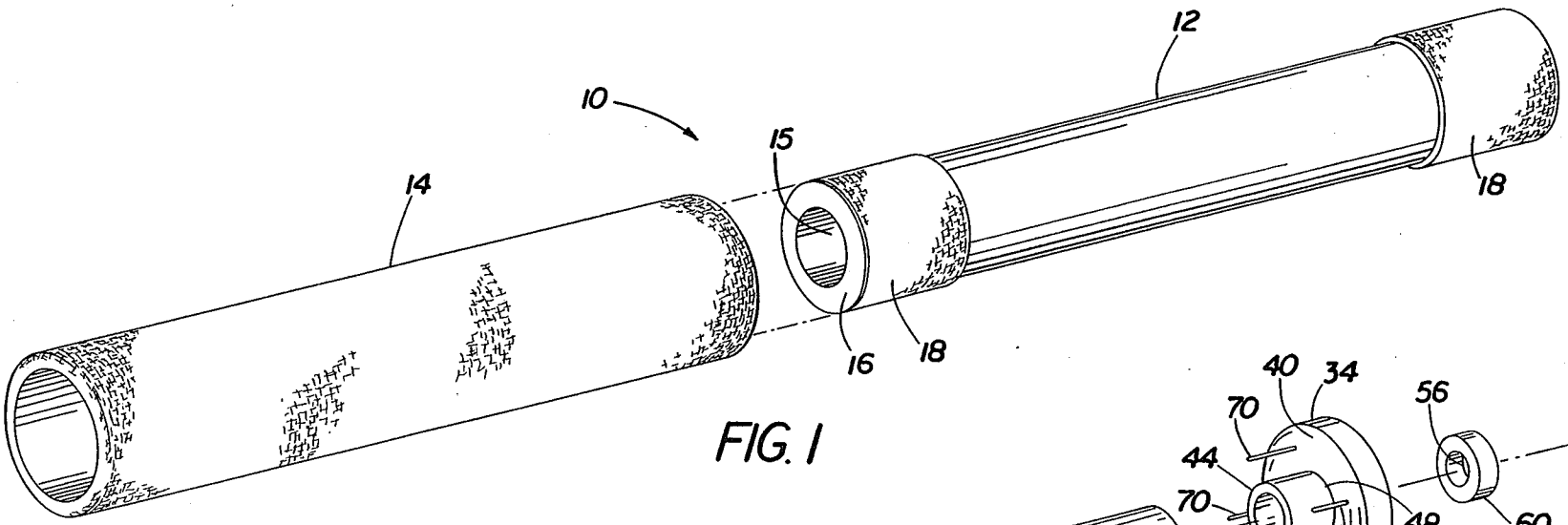
FIG. 1 is an exploded perspective view of a disposable dampener roller cartridge according to the invention.
Figure 3:
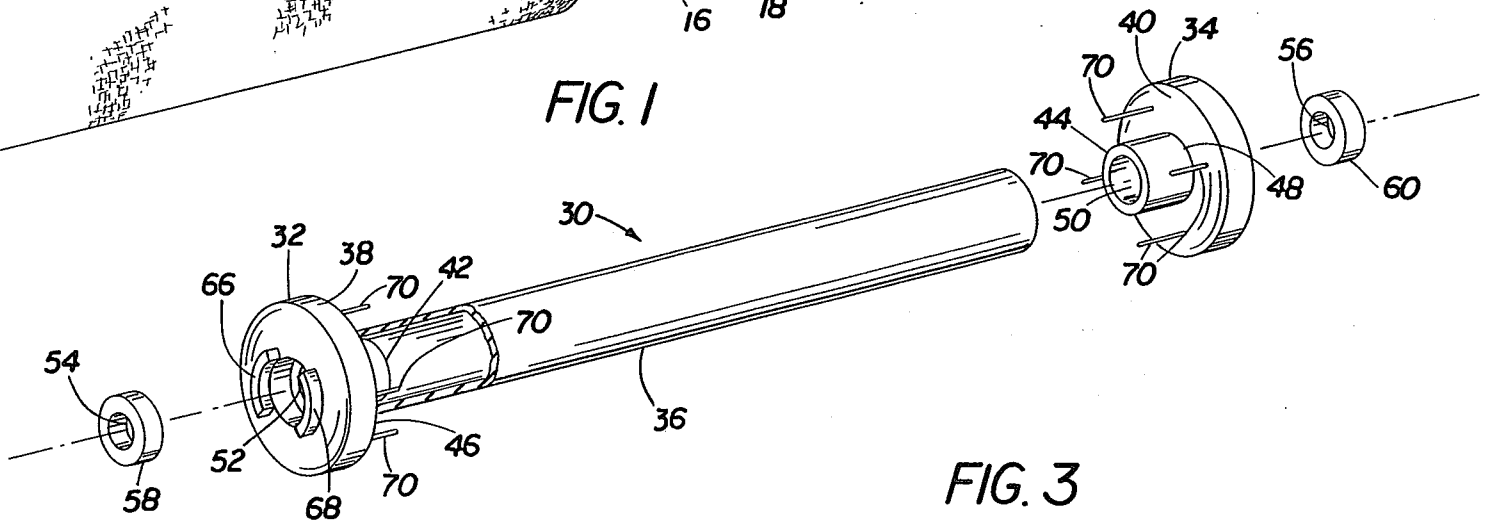
FIG. 3 is an exploded perspective view of a mandrel for the FIG. 1 cartridge.
Figure 2:
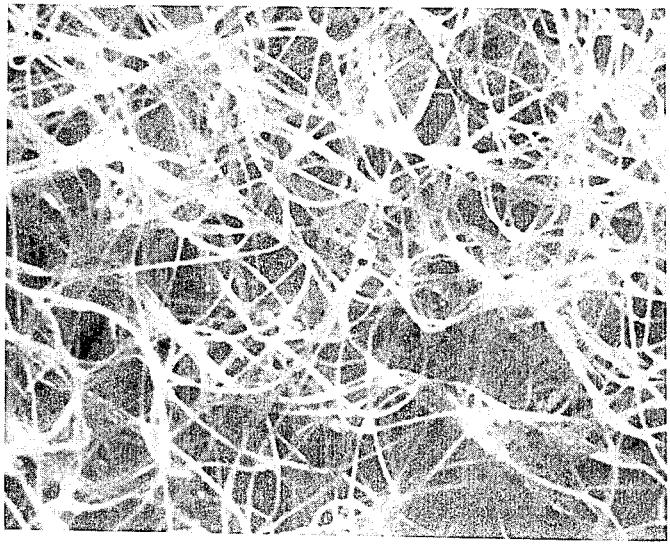
FIG. 2 is a photomicrograph showing the structure of the material of the core tube of the FIG. 1 cartridge.

Referring to FIG. 1, disposable dampener roller cartridge 10 has cylindrical, resilient, plastic network structure core tube 12 and moisture-absorbent outer sleeve 14. The important characteristics of core tube 12 are that it be made of a plastic coherent network structure having a density below 0.5 gram/cc and sufficient resilience to be deformed by a radially applied force and to recover to original shape after the cessation of the force and sufficient rigidity to permit tight, slidable mounting of the core tube on a support cylinder. Core tube 12 can be a melt-blown polypropylene fiber core tube made by extruding molten plastic fibers on a rotating mandrel to form the tube; such core tubes have been used extensively in filters and are commercially available from Facet Enterprises, Inc., Tulsa, Okla. (under the trade designation Facet Web) or Osmonics (under the trade designation Hytrex). (The coherent network structure of melt-blown fiber material is shown in the photomicrograph of FIG. 2.) The plastic coherent network structures can also be made of various other materials so long as they provide the desired properties. These materials include: melt blown fibers of plastics other than polypropylene; foamed plastics, such as foamed polyurethane and foamed polyethylene, particularly extruded, closed cell, skinned, foamed plastics (available, e.g., from Dow Chemical); plastic (preferably polyester, polypropylene or rayon) fibers bonded with phenolic resin and cast into the tube shape on a mandrel (available, e.g., from Cuno); and string wound plastic (preferably polyester, polypropylene or rayon) fibers wound on a tube (available, e.g., from Facet Enterprises, Inc., Cuno or Commercial Filters). Preferably, core tube 12 has a durometer between 40 and 50 (Shore scale A) (most preferably 45). Likewise, density preferably is from 0.15 to 0.25 gram/cc (most preferably 0.20 gram/cc). Central axial bore 15 of tube 12 is $1\frac{1}{8}''$ in diameter and extends the entire length of core tube 12. Wall 16 has a thickness of approximately 9/16", which is one-half of the radius of the tube. The core tube thickness could vary, depending on the application, but should be at least one-third of the radius of the tube and preferably around one-half of the radius.

At each end of core tube 12, and disposed about its entire circumference, is a strip 18 of $2\frac{1}{2}''$ wide, adhesive tape (available from, Fasson Industrial Division of Avery International Corporation, Painesville, Ohio under the designation Haps Bond, Product No. 4131-82) made of a 0.5 mil thick polyethylene terephthalate central support layer, a 2 mil thick layer of rubber-based, pressure-activated adhesive on its side adjacent to core tube 12, and a 2 mil thick layer of thermoplastic, rubber-based, heat-activated adhesive on its other side.

Moisture-absorbent sleeve 14 is a seamless, substantially lint-free, knitted tube made of polyvinyl alcohol and rayon yarns (manufactured by Jomac, Warrington, Pa.), similar to the water-shrunk sleeves mentioned above. Sleeve 14 has a length equal to the length of core tube 12 and an inside diameter sized so as to provide both enough looseness to permit it to be pulled on to core tube 12 and a tight fit about the circumference of core tube 12 when heat-shrunk. The yarn blend of sleeve 14 is hydrophilic and ink-resistive, and is knitted so as to have a looped pile nap.

Figure 4:
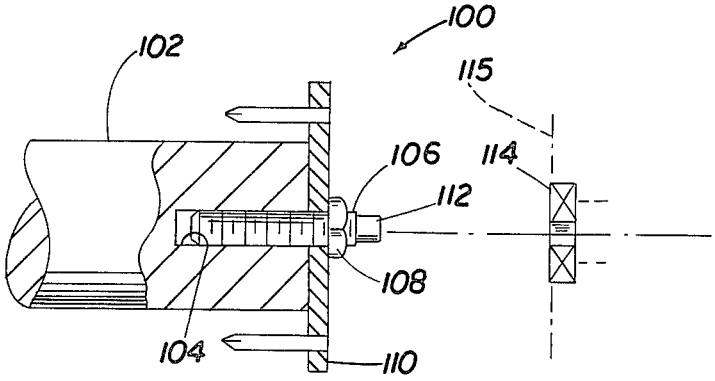
FIG. 4 is a vertical sectional view of an alternative mandrel for the FIG. 1 cartridge.
Figure 5:
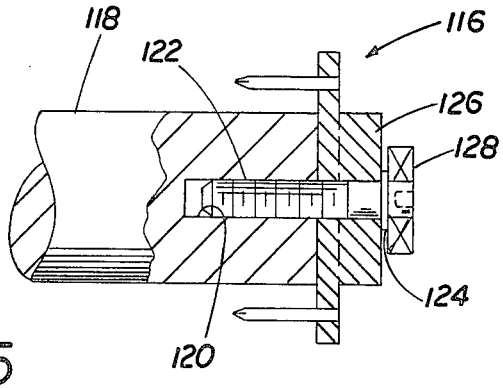
FIG. 5 is a vertical sectional view of another alternative mandrel for the FIG. 1 cartridge.

Dampener roller cartridge 10 is designed to be mounted on one of mandrel assemblies 30 (FIG. 2), 100 (FIG. 4), 116 (FIG. 5). Referring to FIG. 2 first, mandrel assembly 30 is designed to be mounted on a printing press shaft (not shown) that passes through it. It has plastic end caps 32, 34 and a thin-walled aluminum tube 36, which is equal in length to the length of dampener roller cartridge 10, and has an outside diameter slightly smaller than the diameter of bore 14, so as to provide a slidable, but snug, fit of cartridge 10 over tube 36. End caps 32, 34 have flange portions 38, 40, with a diameter smaller than the outer diameter of cartridge 10, and plugs 42, 44, which project perpendicularly approximately $\frac{5}{8}''$ from the inner faces 46, 48 of end caps 32, 34 and are concentric with flange portions 38, 40. Plugs 42, 44 have central, concentric bores 50, 52 with a diameter that is slightly larger than the diameter of the central apertures 54, 56 of bearings 58, 60, which are press-fitted into end caps 32, 34 and are adapted to receive a printing press shaft through them. Plug 42 is cemented into support tube 36 with adhesive, and plug 44 is removable. The outside diameter of plug 44 is slightly smaller than the inside diameter of support tube 36, so that plug 44 fits snugly, yet slidably, into support tube 36. End cap 32 has driving lugs 66, 68 that interconnect with driving means on the printing press (not shown). End caps 32, 34 each have 4 sharp integral plastic retainer pins 70 disposed at 90° positions perpendicular to inner faces 46, 48 so as to penetrate core tube 12 at its ends to prevent rotation of cartridge 10 relative to support tube 36.

In FIG. 4 there is shown mandrel assembly 100 for use in a printing press that does not have a shaft that passes through the dampener roller and in which roller bearings are carried by the printing press. Mandrel assembly 100 includes solid support cylinder 102, which has threaded recess 104 in both ends (only one end is shown) for receiving threaded shaft 106. Nut 108 on shaft 106 holds flat end plate 110 against the end of cylinder 102. Threaded shaft 106 has cylindrical extension 112 for insertion into bearing 114 carried by the printing press apparatus, generally indicated as 115. End cap 110 includes spikes 112 for engaging a dampener roller cartridge 10 (FIG. 1). A similar end cap (not shown) and thread connectors are at the other end of support cylinder 102.

In FIG. 5 there is shown mandrel assembly 116 for use in a printing press that does not have a shaft that passes through the dampener roller and that-does not carry bearings. Mandrel assembly 116 includes solid support cylinder 118, which has threaded recess 120 in an end for receiving threaded shaft 122, which has flange 124 bearing against end cap 126 to hold end cap 126 against the end of cylinder 118. Shaft 122 has a hex-head recess in its exposed end. Press fit on the end of threaded shaft 124 is bearing 128 sized for engagement by an opening in a printing press support member (not shown). A similar end cap and threaded connector (not shown) are at the other end of support cylinder 118.

Manufacture

Strips 18 of adhesive tape are applied circumferentially at each of the ends of core tube 12, and then sleeve 14, having a length equal to core tube 12, is pulled thereon while the heat-activated adhesive is not tacky. This assembly 10 is then placed in an oven and heated to approximately 200° F., preferably, although the temperature may range from 190° to 210°. Roller dampener cartridge 10 is heated for approximately 20 to 60 minutes, the duration depending upon the initial tightness of the fit between core tube 12 and sleeve 14; as heat is applied, sleeve 14 shrinks to fit tightly about core tube 12 and to curve into intimate contact with the heat-activated adhesive on adhesive tape strips 18, which is activated by temperatures in the same range. The heat-activated adhesive assumes the texture of the inner surface of the sleeve during heating. If the initial fit is relatively loose, more heating time may be required to achieve the proper fit, as evidenced by an absence of puckers, wrinkles, or bulges in sleeve 14. During the heat-shrinking step, tape strips 18 prevent sleeve 14 from shrinking in an axial direction.

Operation

In operation, the assembly of dampener roller 10 is mounted on one of the mandrel assemblies 30, 100, 116, depending upon the particular printing press application. The mandrel assembly is attached to an oscillating arm (not shown), which moves dampener roller cartridge 10 back and forth between the water supply (not shown) and the printing plate (not shown). When the press is shut down, dampener roller cartridge 10 may be positioned against a printing plate and under considerable radially applied force, which creates a temporary flat along the length of core tube 12. However, the resiliency of the material from which core tube 12 is made causes tube 12 to return to its original curve upon cessation of application of radial force and continued rolling. This results in smoother, more even distribution of water on the plate. The core tube is seamless and has no other surface irregularities, especially useful in an industry in which uniformity of distribution of the water film is essential.

Core tube 12, because of the thickness of its wall 16 and its low density, has an unusually low moment of inertia, which results in less stress on the printing press during quick acceleration and in longer life for dampener roller 10. Moment of inertia of an annular cylinder is derived from the formula $$I_c = \tfrac{1}{2} m\,(R_I^2 + R_0^2) \times \text{length},$$

where $I_c$ = moment of inertia, m = mass, $R_0$ = outside radius, and $R_I$ = inside radius.

As may be seen, the low mass and low value of $R_I$ of core tube 12 contribute to a low value for the moment of inertia, when compared to, for example, heavy, substantially solid, hard rubber rollers (having approximately the same $R_I$ and $R_0$ as core tube 12) or rollers having thin core tubes with $R_I$ and $R_0$ close in magnitude to each other (assuming the same mass as in core tube 12).

An advantage to the axial threaded connections of mandrels 100, 116 is that if core tubes 12 are slightly longer than the support cylinders 102, 118, the core tubes can be easily compressed to proper size by the threaded connections owing to the large torques that can be applied to them and converted to axial forces.

OTHER EMBODIMENTS

Other embodiments of the invention are within the scope of the following claims.

What is claimed is:

1. A dampener roller cartridge for mounting on a cylindrical support comprising a core tube of plastic substance having a central bore to receive said cylindrical support, said core tube characterized by having an annular wall thickness at least one third the radius of the tube, and a coherent network structure providing a density of less than 0.5 gram/cc, said plastic substance and said network structure providing said tube with sufficient resilience to be resiliently deformed by a radially applied force by a mating roller and to recover its original shape after the cessation of said radially applied force, and further providing said tube with sufficient rigidity to permit tight slidable mounting of said core tube on said cylindrical support, and a moisture-absorbent, outer sleeve secured about the circumference of said core tube.

2. The dampener roller cartridge of claim 1 wherein said moisture-absorbent, outer sleeve is a seamless fabric.

3. The dampener roller cartridge of claim 2 wherein said sleeve is heat-shrunk to fit tightly about the circumference of said core tube.

4. The dampener roller cartridge of claim 2 wherein said fabric is a looped pile of polyvinyl alcohol yarn and rayon yarn.

5. The dampener roller cartridge of claim 1 wherein said sleeve is heat-shrunk to fit tightly about the circumference of said core tube.

6. The dampener roller cartridge of claim 5 further comprising adhesive tape circumferentially disposed about said core tube intermediate said core tube and said outer sleeve in order to prevent axial and circumferential movement of said sleeve on said core tube, said adhesive tape being a thin plastic film having adhesive on each side, the adhesive on the side of said tape adjacent to said core tube being pressure-activated, and the adhesive on the side of the tape adjacent said outer sleeve being heat-activated.

7. The dampener roller cartridge of claim 6 wherein there are two pieces of adhesive tape, said pieces of adhesive tape being located near the ends of said core tube.

8. The dampener roller cartridge of claim 1 wherein said coherent network comprises a mass of melt-blown plastic fibers formed into said core.

9. The dampener roller cartridge of claim 8 wherein said plastic substance comprises polyolefin.

10. The dampener roller cartridge of claim 9 wherein said network comprises melt-blown polypropylene fibers.

11. The dampener roller of claim 1 wherein said coherent network comprises a plastic foam.

12. The dampener roller of claim 11 wherein said coherent network comprises foamed polyethylene or foamed polyurethane.

13. The dampener roller of claim 1 wherein said coherent network comprises plastic fibers bonded with phenolic resin.

14. The dampener roller of claim 1 wherein said coherent network comprises string wound plastic fibers.

15. The dampener roller of claim 13 or 14 wherein said fibers comprise polyester, polypropylene or rayon.

16. The dampener roller cartridge of claim 1 wherein said coherent network has a shore scale A durometer between 40 and 50.

17. The dampener roller cartridge of claim 1 wherein said coherent network has a density between 0.15 and 0.25 gram/cc.

18. A core tube for use with a moisture-absorbent outer sleeve as a dampener roller cartridge for mounting on a cylindrical support, said core tube being made of plastic substance having a central bore to receive said cylindrical support, said core tube characterized by having an annular wall thickness at least one third the radius of the tube, and a coherent network structure providing a density of between 0.15 and 0.25 gram/cc, said plastic substance in said network structure providing said tube with sufficient resilience to be resiliently deformed by a radially applied force by a mating roller and to recover its original shape after the cessation of said radially applied force, and further providing said tube with sufficient rigidity to permit tight slidable mounting of said core tube on said cylindrical support, said coherent network comprising a mass of melt-blown polypropylene fibers formed into said core, said coherent network having a Shore scale A durometer between 40 and 50.

* * * * *